US010732661B1

(12) United States Patent
Arndt et al.

(10) Patent No.: US 10,732,661 B1
(45) Date of Patent: Aug. 4, 2020

(54) CYCLIC SWITCHING DESIGN TO REDUCE RTN IN BANDGAP CIRCUITS

(71) Applicant: Apple Inc., Cupertino, CA (US)

(72) Inventors: Gregory B. Arndt, San Jose, CA (US); Salvatore Reddiconto, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/569,589

(22) Filed: Sep. 12, 2019

(51) Int. Cl.
*G05F 3/26* (2006.01)
*G05F 3/30* (2006.01)
*G05F 3/22* (2006.01)

(52) U.S. Cl.
CPC ..... *G05F 3/265* (2013.01); *G05F 3/222* (2013.01); *G05F 3/30* (2013.01)

(58) Field of Classification Search
CPC ..... G05F 3/265; G05F 3/30; G05F 3/222
See application file for complete search history.

(56) References Cited

U.S. PATENT DOCUMENTS

2007/0296392 A1* 12/2007 Chen ..... G05F 3/30 323/313
2010/0295529 A1* 11/2010 Consoer ..... G05F 3/30 323/313
2015/0261246 A1* 9/2015 Doorenbos ..... G05F 3/02 323/268

* cited by examiner

*Primary Examiner* — Jue Zhang
(74) *Attorney, Agent, or Firm* — Morgan, Lewis & Bockius LLP

(57) ABSTRACT

Aspects of the subject technology relate to a circuit for reducing random-telegraph noise in bandgap circuits. The circuit includes a number of diodes coupled in parallel at their respective first nodes to a ground potential. A number of switches are coupled to respective second nodes of the diodes. The circuit further includes a first resistor and a resistor voltage divider. The first node of the first resistor is coupled to a first node of a current source, and the first node of the resistor voltage divider is coupled to the first node of the current source. The switches are used to implement cyclic switching of the diodes in response to a train of pulses. An output voltage of the circuit is derived between a mid-node of the resistor voltage divider and a second node of the first resistor.

20 Claims, 4 Drawing Sheets

CYCLIC SWITCHING DESIGN TO REDUCE RTN IN BANDGAP CIRCUITS

TECHNICAL FIELD

The present description relates generally to integrated circuits, and more particularly, but not exclusively, to a cyclic switching design to reduce random telegraph noise (RTN) in bandgap circuits.

BACKGROUND

Random telegraph noise (RTN), also referred to as burst noise, popcorn noise or impulse noise, is an electronic noise that can occur in semiconductors and ultra-thin gate oxide films. The RTN consists of sudden step-like transitions between two or more discrete current or voltage levels. The RTN has a random nature and can occur at unpredictable times and cause voltage shifts as high as several hundred microvolts. The shift in offset voltage or current can last from several milliseconds to several seconds. Such a shift can be problematic in many applications.

As an example application, a number of sensor devices such as pressure sensors may operate by using a reference voltage or current provided by an electronic circuit such as an application-specific integrated circuit (ASIC) as their bias voltage or current. Typically, the reference voltage is generated by a bandgap circuit that is shown to be sensitive to the RTN. The RTN, in this case, can manifest itself as a sudden base current increase in one of the bipolar transistors of the bandgap circuit that results in an error in the bandgap voltage reference, and, in turn, translates into inaccurate pressure reading of the pressure sensor.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
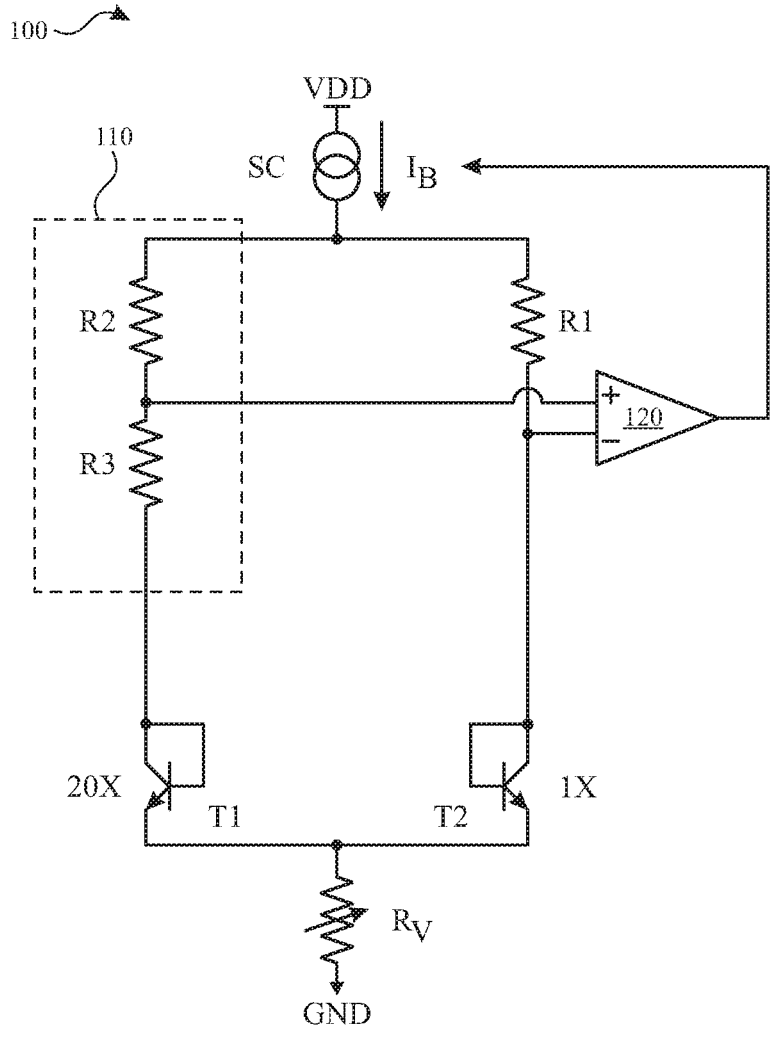
FIG. 1 is a schematic diagram illustrating an example electronic circuit in which various aspect of the subject technology can be implemented.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject technology is directed to a circuit for cyclic switching of a number of diodes for reducing random telegraph noise (RTN). The disclosed circuit includes a number of diodes coupled in parallel at their respective first nodes to a ground potential. A number of switches are coupled to the respective second nodes of the diodes. The circuit further includes a first resistor, a resistor voltage divider and a current source. The first node of the first resistor and the first node of the resistor voltage divider are coupled to a first node of the current source. The switches are used to implement cyclic switching of the diodes in response to a train of pulses. An output voltage of the circuit is derived between a mid-node of the resistor voltage divider and a second node of the first resistor.

In one or more implementations, the cyclic switching of the diodes is implemented by each switch coupling a second node of a respective one of the diodes to the second node of the first resistor in response to a respective signal applied to that switch, while other switches couple second nodes of other diodes to a second node of the resistor voltage divider. The respective signal is a pulse of the train of pulses that are sequentially applied to switches, have equal pulse widths and are provided at equal time intervals. The second node of the current source is coupled to bias voltage, and the respective first nodes of the diodes are coupled to the ground potential through a variable resistor. The cyclic switching of the diodes by the switches enables reducing RTN.

In some implementations, a portable communication device includes a sensor that operates based on a reference voltage and a bandgap circuit that provides the reference voltage. The bandgap circuit includes a number of diodes, a number of switches, a first resistor, a voltage divider and a current source. The first nodes of the diodes are coupled to a ground potential, and the switches are coupled to respective second nodes of the diodes and enable cyclic switching of the diodes in response to a train of pulses. The first node of the first resistor is coupled to a first node of the current source. The first node of the voltage divider is coupled to the first node of the current source. The reference voltage is derived between a mid-node of the voltage divider and the second node of the first resistor.

FIG. 1 is a schematic diagram illustrating an example electronic circuit 100 in which various aspects of the subject technology can be implemented. The electronic circuit 100 is known as a bandgap circuit and includes transistors T1 and T2, such as bipolar-junction transistors, a voltage divider 110, a first resistor R1, a current source Sc and a variable resistor Rv. The voltage divider 110 is a resistor voltage divider including resistors R2 and R3. The first nodes of the first resistor R1 and the voltage divider 110 are connected to the first node of the current source Sc. The second node of the current source Sc is connected to a bias voltage VDD, and the current source Sc provides a bias current $I_B$ for the bandgap circuit. The second node of the voltage divider 110 is connected to the collector node of the transistor T1, and the second node of the first resistor R1 is connected to the collector node of the transistor T2. The emitter nodes of the transistors T1 and T2 are connected to the ground (GND). The collector nodes of the transistors T1 and T2 are coupled to their respective base nodes, so that these transistors are connected to operate as diodes and can be referred to as diode-connected transistors or simply diodes.

The output of the bandgap circuit is taken from the middle node of the voltage divider 110 and the collector node of the transistor T2 that are connected to input nodes of a differential amplifier 120. The output of the differential amplifier 120 is a reference voltage that can be used in a number of applications, for example, in an application-specific integrated circuit (ASIC) used with a sensor such as a pressure sensor or in an RF circuit.

Recently, it has been shown that bandgap circuits are prone to RTN, which can manifest itself as a sudden base current increase in the bipolar transistors T1 and T2. This sudden current jump is limited in time and occurs randomly. If such current is generated in transistor T2, which by design has a smaller (e.g., 20 times) current than transistor T1, it would have a greater effect on the output voltage of the bandgap circuit, as explained below. The subject technology improves the bandgap circuit by adding switches to mitigate the RTN issue and provides a more stable reference voltage, as described herein.

Figure 2:
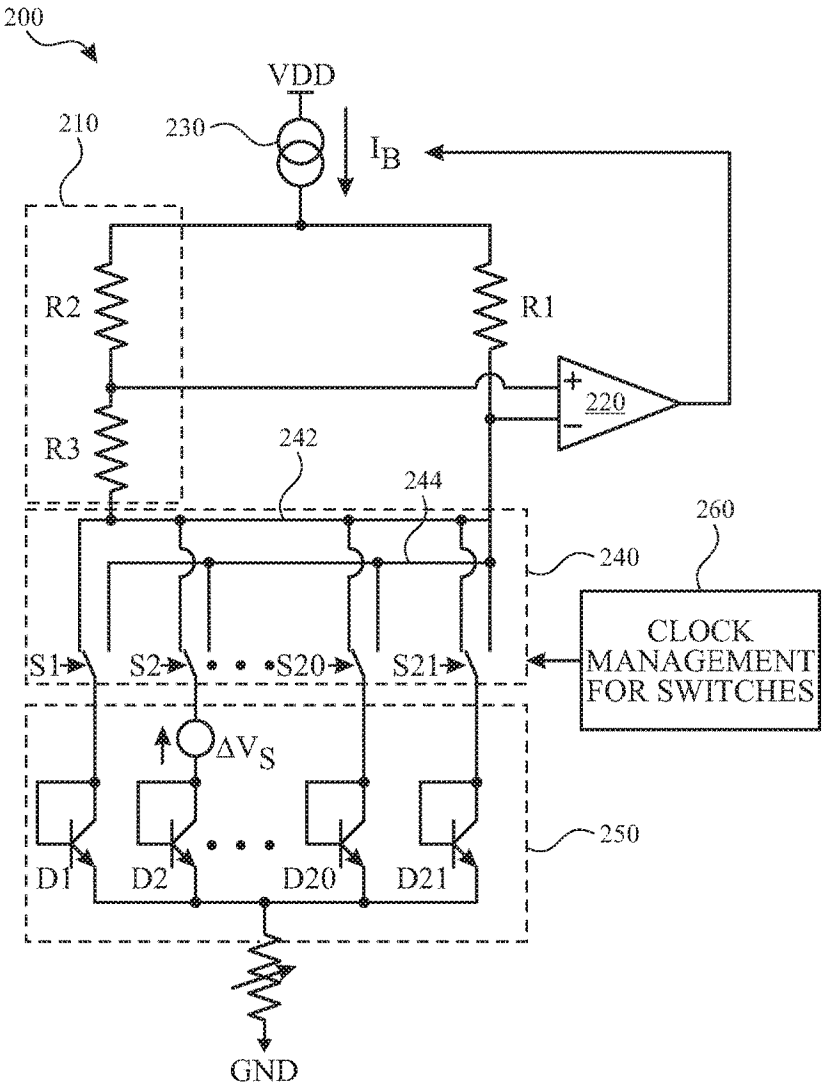
FIG. 2 is a schematic diagram illustrating an example electronic circuit, in accordance with various aspects of the subject technology.

FIG. 2 is a schematic diagram illustrating an example electronic circuit 200, in accordance with various aspects of the subject technology. The electronic circuit 200 is an improved version of the bandgap circuit of FIG. 1 that can provide a reference voltage with reduced RTN. The electronic circuit 200 is similar to the electronic circuit 100 of FIG. 1, except for the diode block 250 that replaces diode-connected transistors T1 and T2 of FIG. 1 and the addition of a switch block 240 and a clock management circuit 260. For example, the connections of the voltage divider 210 and the resistor R1 are similar to the voltage divider 110 and the resistor R1 of FIG. 1.

It is understood that the larger diode-connected transistor T1 of FIG. 1 is normally implemented on a die by realizing a number of (e.g., 20 or less) individual diode-connected transistors, which are represented as diodes D1, D2 . . . D20 in the diode block 250. The diode-connected transistor T2 of FIG. 1 is represented by a diode D21. The switch block 240 includes a number (e.g., 21) of switches (S1, S2 . . . S21) that are individually operated by the clock management circuit 260. Each switch of the switch block 240 can be operated to connect a corresponding diode (of D1, D2 . . . D21) of the diode block 250 to either rail 242 or rail 244, and rail 242 and rail 244 are respectively connected to the second nodes of the voltage divider 210 and the resistor R1. The effect of the RTN on the output voltage of the bandgap circuit 200 can be modeled as a voltage source represented by ΔVs shown between the switch S2 and the diode D2.

The clock management circuit 260 can implement a cyclic switching of the diodes (D1, D2 . . . D21) of the diode block 250 by operating each switch (e.g., S1) to connect a second node of a corresponding diode (e.g., D1) of the diode block 250 to the rail 244 in response to a respective signal applied to that switch, while operating other switches (e.g., S2 . . . S21) of the switch block 240 to connect the second nodes of other diodes (e.g., D2 . . . D21) to the rail 242. The clock management circuit 260 implements the cyclic switching of the diodes (D1, D2 . . . D21) of the diode block 250 by generating a train of pulses for controlling operations of the switches S1, S2 . . . S21, as described herein. The cyclic switching allows the diodes that are connected to the rail 242 (replacing diode-connected transistor T1 of FIG. 1) to not be always the same and rotate between the diodes D1, D2 . . . D21. Accordingly, the RTN occurring in any of the diodes (e.g., D1) would have a greatly reduced effect (e.g., by a factor of √20) on the reference voltage generated by the differential amplifier 220, as the current passing through that diode (e.g., D1) is 20 times less than the current passing through the diode-connected transistor T1 of FIG. 1. In other words, the improved bandgap circuit of the subject technology has a greatly reduced RTN.

Figure 3:
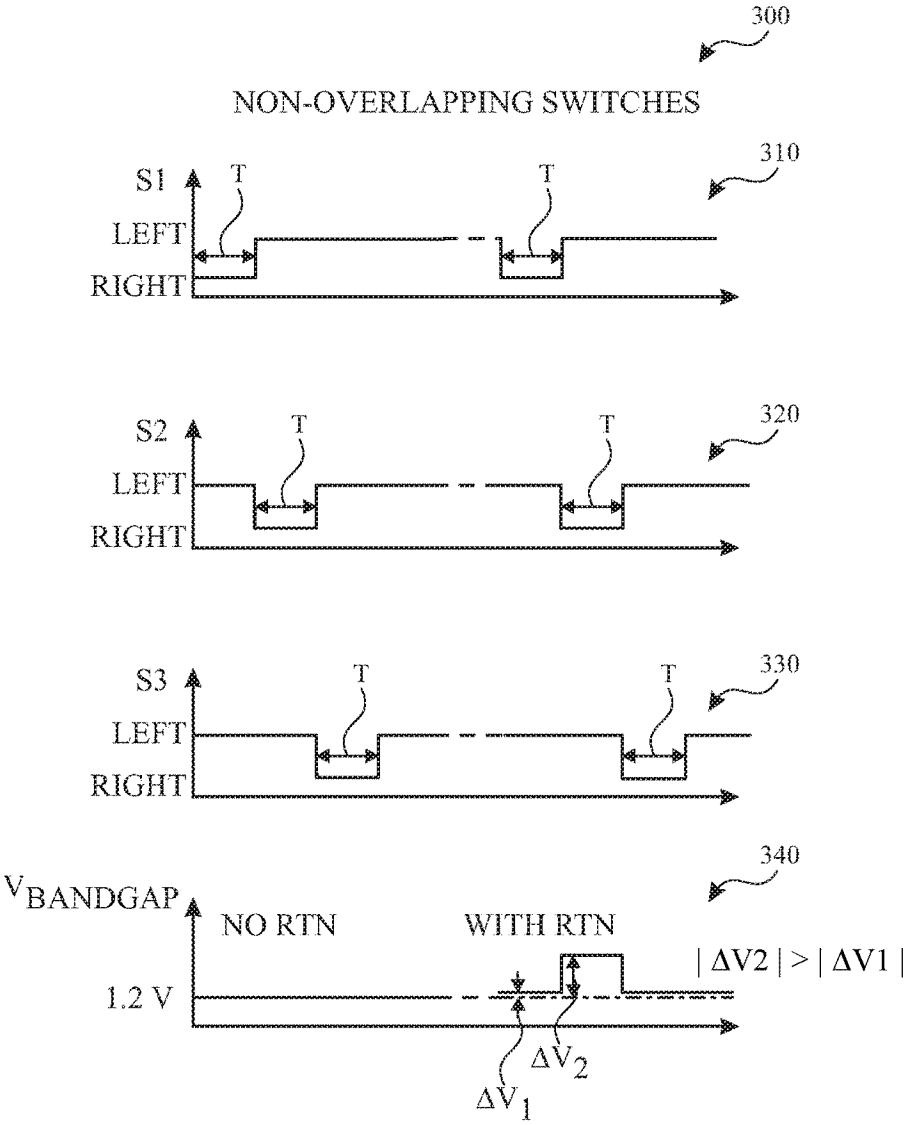
FIG. 3 is a timing chart illustrating a train of pulses used to control switches of the example electronic circuit of FIG. 2 as well as a bandgap voltage plot, in accordance with various aspects of the subject technology.

FIG. 3 is a timing chart illustrating a train of pulses 300 used to control switches of the example electronic circuit 200 of FIG. 2 as well as a bandgap voltage plot 340 in accordance with various aspects of the subject technology. The train of pulses 300 depicts pulses 310, 320 and 330, which are samples of a larger number of pulses (e.g., 21 pulses) corresponding to the switches of the switch block 240 of FIG. 2. The pulses 310, 320 and 330 have equal pulse widths (T), are provided at equal time intervals, and are sequentially applied to switches of the switch block 240 by the clock management circuit 260 of FIG. 2. For example, when the pulse 310 is applied by the clock management circuit 260 to the switch S1, its connection configuration transitions from connecting D1 to the rail 242 to connecting D1 to the rail 244. As is shown in the chart of FIG. 2, while D1 is connected to rail 244, the connection configuration of other switches (e.g., S2 and S3) is such that they connect diodes D2 and D3 to the rail 242. In other words, the diodes being connected to the rail 242 periodically alternate between diodes of the diode block 250, and, as explained above, the RTN occurring in any of the diodes would have a greatly reduced effect (e.g., by a factor of 20) on the reference voltage generated by the differential amplifier 220 of FIG. 2.

The bandgap voltage plot 340 depicts the result of reducing RTN by the subject technology on the reference voltage produced by the bandgap circuit 200. For the bandgap circuit 100 of FIG. 1, when the RTN occurs on transistor T2, the bandgap voltage would experience a jump ΔV2 in its value. When the RTN occurs on transistor T1, the jump magnitude (ΔV1) would scale as √20 times smaller ($\Delta V1=a*\Delta V2/\sqrt{20}$ where a is a constant that depends on the resistance values for R1, R2 and R3). Now referring to the bandgap circuit 200, from the plot 340, if the RTN occurs on diode D21, the bandgap output voltage is increased by ΔV1 when the switch S21 is connected to the rail 242 and by ΔV2 when the switch S21 is connected to the rail 244. The average voltage impact of the RTN on the bandgap voltage would be: $(20\ \text{periods}*\Delta V1+1\ \text{period}*\Delta V2)/21\ \text{periods}=(20*a*\Delta V2/\sqrt{20}+\Delta V2)/21=(a*\sqrt{20}+1)*\Delta V2/21$. The constant a typically being around 1 or 2, the bandgap added error due to RTN is about 2 times lower than in the state of the art (e.g., bandgap circuit 100 of FIG. 1) when the RTN occurs on transistor T1. The other added benefit of the subject technology, as implemented by the bandgap circuit 200, is that the added error due to RTN would be agnostic of which diode the RTN occurs in, which makes the circuit design more consistent.

Figure 4:
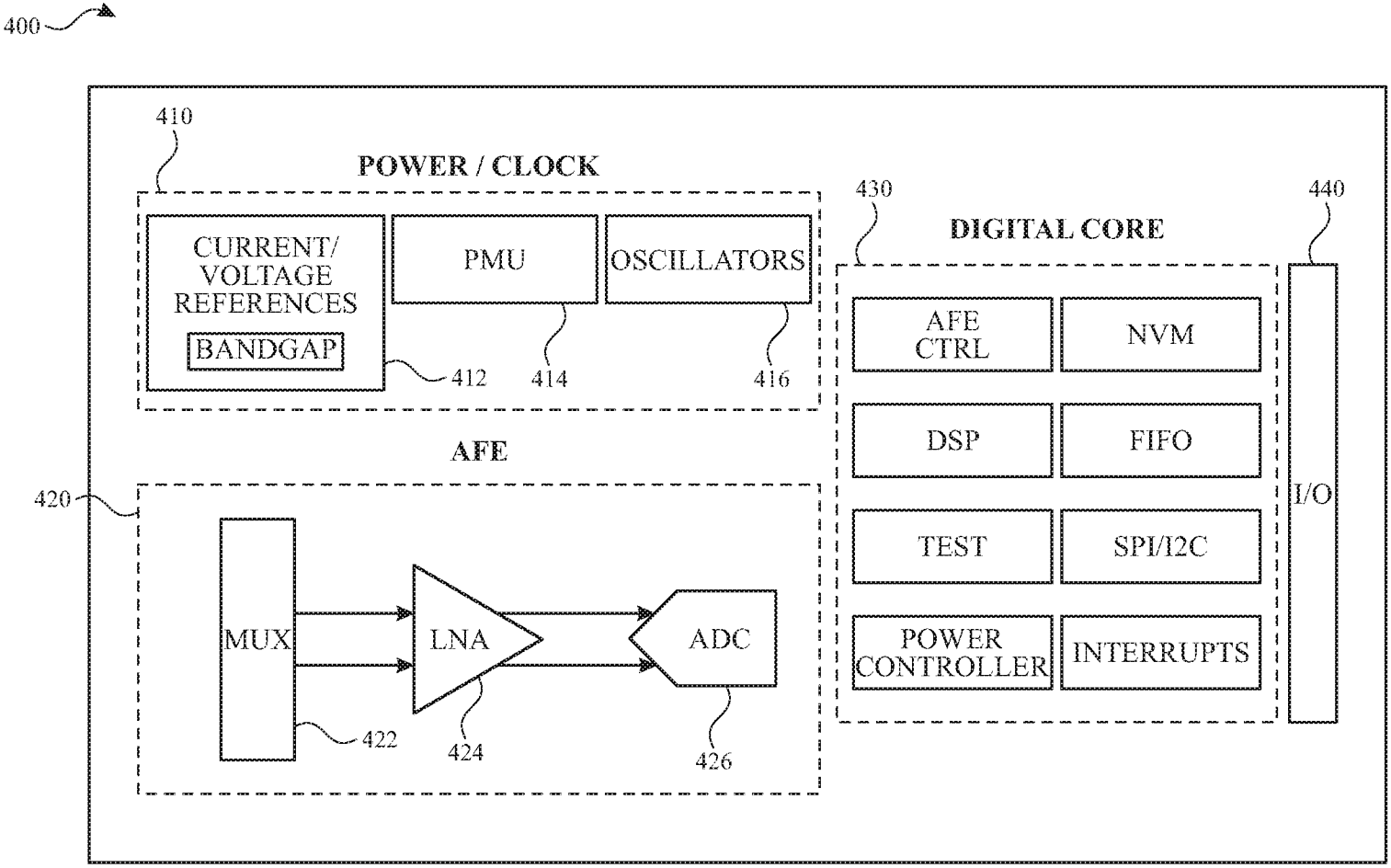
FIG. 4 is a schematic diagram illustrating an example sensor application-specific integrated circuit (ASIC) using the electronic circuit of FIG. 2, in accordance with various aspects of the subject technology.

FIG. 4 is a schematic diagram illustrating an example sensor ASIC system 400 using the electronic circuit 200 of FIG. 2, in accordance with various aspects of the subject technology. The sensor ASIC 400 includes a power/clock block 410, an analog front end (AFE) 420 and a digital core 430. The power/clock block 410 includes a current and/or voltage reference block 412, a power-management unit (PMU) 414 and an oscillator 416. The current and/or voltage reference block 412 includes a bandgap circuit that provides one or more reference voltages or currents from which a number of bias voltages or currents needed for operation of various circuits of the sensor ASIC 400 are derived. The bandgap circuit can be implemented based on the techniques of the subject technology, as shown in FIG. 2, to drastically reduce RTN. The PMU 414 is responsible for managing power distribution among various blocks of the sensor ASIC 400, and the oscillator 416 generates clocks for synchronizing operations of various components, particularly, various components of the digital core 430.

The AFE 420 is well known and includes, but is not limited to, a multiplexer (MUX) 422, a low-noise amplifier (LNA) 424 and an analog-to-digital converter 426. The digital core 430 receives digital signals provided by the AFE 420 and processes the digital signals via a number of digital modules such as an AFE control, a nonvolatile memory (NVM), a digital-signal processor (DSP), a first-in-first-out (FIFO), a test, a serial-peripheral interface (SPI) and/or inter-IC (I2C), a power controller and an interrupts module. The PMU, 414, the oscillator 416, the AFE 420 and the digital core 430 will benefit from the more stable reference voltages or currents by the bandgap circuit of the subject technology that is significantly less prone to RTN.

Figure 5:
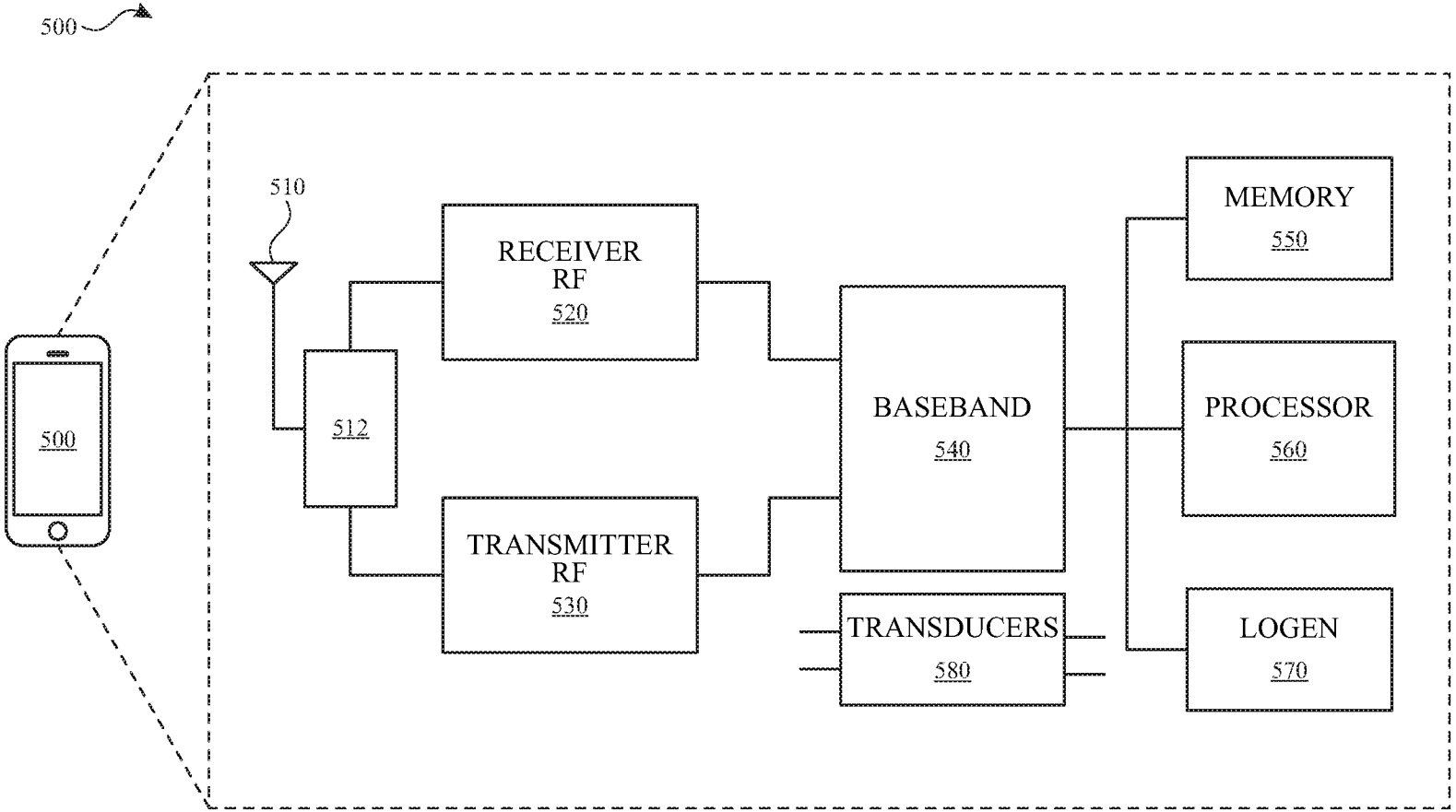
FIG. 5 is a schematic diagram illustrating an example wireless communication device within which some aspects of the subject technology are implemented.

FIG. 5 is a schematic diagram illustrating an example wireless communication device 500 within which some aspects of the subject technology are implemented. The wireless communication device 500 may include an RF antenna 510, a duplexer 512, a receiver 520, a transmitter 530, a baseband processing module 540, a memory 550, a processor 560, a local oscillator generator (LOGEN) 570 and transducers 580. In various embodiments of the subject technology, one or more of the blocks represented in FIG. 5 may be integrated on one or more semiconductor substrates. For example, the blocks 520-570 may be realized in a single chip or a single system on a chip, or may be realized in a multi-chip chipset.

The RF antenna 510 may be suitable for transmitting and/or receiving RF signals (e.g., wireless signals) over a wide range of frequencies (e.g., 60 GHz band). Although a single RF antenna 510 is illustrated, the subject technology is not so limited.

The receiver 520 may comprise suitable logic circuitry and/or code that may be operable to receive and process signals from the RF antenna 510. The receiver 520 may, for example, be operable to amplify and/or down-convert received wireless signals. In various embodiments of the subject technology, the receiver 520 may be operable to cancel noise in received signals and may be linear over a wide range of frequencies. In this manner, the receiver 520 may be suitable for receiving signals in accordance with a variety of wireless standards, such as Wi-Fi, WiMAX, Bluetooth, and various cellular standards. In various embodiments of the subject technology, the receiver 520 may not require any surface acoustic wave (SAW) filters and few or no off-chip discrete components such as large capacitors and inductors.

The transmitter 530 may comprise suitable logic circuitry and/or code that may be operable to process and transmit signals from the RF antenna 510. The transmitter 530 may, for example, be operable to up-convert baseband signals to RF signals and amplify RF signals. In various embodiments of the subject technology, the transmitter 530 may be operable to up-convert and amplify baseband signals processed in accordance with a variety of wireless standards. Examples of such standards may include Wi-Fi, WiMAX, Bluetooth, and various cellular standards. In various embodiments of the subject technology, the transmitter 530 may be operable to provide signals for further amplification by one or more power amplifiers.

The duplexer 512 may provide isolation in the transmit band to avoid saturation of the receiver 520 or damaging parts of the receiver 520, and to relax one or more design requirements of the receiver 520. Furthermore, the duplexer 512 may attenuate the noise in the receive band. The duplexer may be operable in multiple frequency bands of various wireless standards.

The baseband processing module 540 may comprise suitable logic, circuitry, interfaces, and/or code that may be operable to perform processing of baseband signals. The baseband processing module 540 may, for example, analyze received signals and generate control and/or feedback signals for configuring various components of the wireless communication device 500 such as the receiver 520. The baseband processing module 540 may be operable to encode, decode, transcode, modulate, demodulate, encrypt, decrypt, scramble, descramble, and/or otherwise process data in accordance with one or more wireless standards.

The processor 560 may comprise suitable logic, circuitry, and/or code that may enable processing data and/or controlling operations of the wireless communication device 500. In this regard, the processor 560 may be enabled to provide control signals to various other portions of the wireless communication device 500. The processor 560 may also control transfers of data between various portions of the wireless communication device 500. Additionally, the processor 560 may enable the implementation of an operating system or otherwise execute code to manage operations of the wireless communication device 500.

The memory 550 may comprise suitable logic, circuitry, and/or code that may enable the storage of various types of information such as received data, generated data, code, and/or configuration information. The memory 550 may comprise, for example, RAM, ROM, flash, and/or magnetic storage. In various embodiments of the subject technology, information stored in the memory 550 may be utilized for configuring the receiver 520 and/or the baseband processing module 540.

The LOGEN 570 may comprise suitable logic, circuitry, interfaces, and/or code that may be operable to generate one or more oscillating signals of one or more frequencies. The LOGEN 570 may be operable to generate digital and/or analog signals. In this manner, the LOGEN 570 may be operable to generate one or more clock signals and/or sinusoidal signals. Characteristics of the oscillating signals such as the frequency and duty cycle may be determined based on one or more control signals from, for example, the processor 560 and/or the baseband processing module 540.

In operation, the processor 560 may configure the various components of the wireless communication device 500 based on a wireless standard according to which it is desired to receive signals. Wireless signals may be received via the RF antenna 510 and amplified and down-converted by the receiver 520. The baseband processing module 540 may perform noise estimation and/or noise cancellation, decoding, and/or demodulation of the baseband signals. In this manner, information in the received signal may be recovered and utilized appropriately. For example, the information may be audio and/or video to be presented to a user of the wireless communication device 500, data to be stored to the memory 550, and/or information affecting and/or enabling operation of the wireless communication device 500. The baseband processing module 540 may modulate, encode and perform other processing on audio, video, and/or control signals to be transmitted by the transmitter 530 in accordance to various wireless standards.

In some implementations, the transducers 580 may include speakers, microphones and sensors such as pressure sensors, gas sensors, environmental sensors, particle detectors or other sensors. The transducers 580 may use a reference voltage that can be provided by the bandgap circuit with reduced RTN using a cyclic switching design of the subject technology.

In one or more aspect of the subject technology, a circuit includes a number of diodes coupled in parallel at their respective first nodes to a ground potential. A number of switches are coupled to respective second nodes of the diodes. The circuit further includes a first resistor and a resistor voltage divider. The first node of the first resistor is coupled to a first node of a current source, and the first node of the resistor voltage divider is coupled to the first node of the current source. The switches are used to implement cyclic switching of the diodes in response to a train of pulses. An output voltage of the circuit is derived between a mid-node of the resistor voltage divider and a second node of the first resistor.

In other aspects, a portable communication device includes a sensor that operates based on a reference voltage, and a bandgap circuit that provides the reference voltage. The bandgap circuit includes a number of diodes and a number of switches. First nodes of the diodes are coupled to a ground potential, and the switches are coupled to respective second nodes of the diodes to enable cyclic switching of the diodes in response to a train of pulses. A first resistor is coupled to a first node of a current source at a first node of the first resistor, and a voltage divider is coupled to the first node of the current source at a first node of the voltage divider. An output voltage of the bandgap circuit is derived between a mid-node of the voltage divider and a second node of the first resistor.

In yet other aspects, a cyclic switching circuit includes a current source, a number of diodes, a number of switches and a differential amplifier circuit. The first node of the current source is coupled to a first node of a first resistor and to the first node of a resistor voltage divider. The diodes are coupled in parallel at their respective first nodes to a ground potential. The switches are coupled to respective second nodes of the diodes. The switches are used to implement cyclic switching of the diodes in response to a train of pulses to reduce RTN. Input nodes of the differential amplifier circuit are coupled to the mid-node of the resistor voltage divider and the second node of the first resistor, and the differential amplifier circuit generates a reduced RTN reference voltage.

Various functions described above can be implemented in digital electronic circuitry as well as computer software, firmware or hardware. The techniques can be implemented using one or more computer program products. Programmable processors and computers can be included in or packaged as mobile devices. The processes and logic flows can be performed by one or more programmable processors and by one or more programmable logic circuitries. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW), flash memory (e.g., SD cards, mini-SD cards, micro-SD cards), magnetic and/or solid state hard drives, ultra density optical discs, any other optical or magnetic media, and floppy disks. The computer-readable media can store a computer program that is executable by at least one processing unit and includes sets of instructions for various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as ASICs or field-programmable gate arrays (FPGAs). In some implementations, such integrated circuits execute instructions that are stored on the circuits themselves.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer-readable medium" and "computer-readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer-readable storage medium (also referred to as computer-readable medium). When these instructions are executed by one or more processing unit(s) (e.g., one or more processors, cores of processors, or other processing units), they cause the processing unit(s) to perform the actions indicated in the instructions. Examples of computer-readable media include, but are not limited to, CD-ROMs, flash drives, RAM chips, hard drives, EPROMs, etc. The computer-readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A circuit comprising:

a plurality of diodes coupled in parallel at respective first nodes of the plurality of diodes to a ground potential;

a plurality of switches coupled to respective second nodes of the plurality of diodes;

a first resistor, a first node of the first resistor being coupled to a first node of a current source; and a resistor voltage divider, a first node of the resistor voltage divider being coupled to the first node of the current source, wherein:

the plurality of switches are used to implement cyclic switching of the plurality of diodes in response to a train of pulses, and an output voltage of the circuit is derived between a mid-node of the resistor voltage divider and a second node of the first resistor.

2. The circuit of claim 1, wherein the cyclic switching of the plurality of diodes is implemented by configuring each switch of the plurality of switches to couple a second node of a respective one of the plurality of diodes to the second node of the first resistor in response to a respective signal applied to that switch, while other switches of the plurality of switches are configured to couple second nodes of other diodes of the plurality of diodes to a second node of the resistor voltage divider.

3. The circuit of claim 2, wherein the respective signal comprises a pulse of the train of pulses, and wherein the pulses of the train of pulses are sequentially applied to switches of the plurality of switches.

4. The circuit of claim 3, wherein pulses of the train of pulses have equal pulse widths and are provided at equal time intervals.

5. The circuit of claim 1, wherein a second node of the current source is coupled to bias voltage.

6. The circuit of claim 1, wherein the respective first nodes of the plurality of diodes are coupled to the ground potential through a variable resistor.

7. The circuit of claim 1, wherein the cyclic switching of the plurality of diodes by the plurality of switches is configured to enable reducing random telegraph noise (RTN).

8. The circuit of claim 1, further comprising a clock management circuit configured to generate the train of pulses for controlling operations of the plurality of switches.

9. The circuit of claim 1, further comprising an amplifier circuit configured to convert the output voltage to a stable reference voltage.

10. A portable communication device comprising:

a sensor configured to operate based on a reference voltage; and a bandgap circuit configured to provide the reference voltage, the bandgap circuit comprising:

a plurality of diodes, first nodes of the plurality of diodes being coupled to a ground potential;

a plurality of switches coupled to respective second nodes of the plurality of diodes and configured to enable cyclic switching of the plurality of diodes in response to a train of pulses;

a first resistor coupled to a first node of a current source at a first node of the first resistor; and a voltage divider coupled to the first node of the current source at a first node of the voltage divider, wherein an output voltage of the bandgap circuit is derived between a mid-node of the voltage divider and a second node of the first resistor.

11. The portable communication device of claim 10, further comprising a clock management circuit configured to generate the train of pulses for controlling operations of the plurality of switches.

12. The portable communication device of claim 11, wherein the clock management circuit is configured to implement the cyclic switching of the plurality of diodes by operating each switch of the plurality of switches to couple a second node of a respective one of the plurality of diodes to the second node of the first resistor in response to a respective signal applied to that switch, while operating other switches of the plurality of switches to couple second nodes of other diodes of the plurality of diodes to a second node of the voltage divider.

13. The portable communication device of claim 12, wherein the respective signal comprises a pulse of the train of pulses, and wherein the clock management circuit is configured to sequentially apply the pulses of the train of pulses to switches of the plurality of switches.

14. The portable communication device of claim 12, wherein the clock management circuit is configured to implement the cyclic switching of the plurality of diodes to enable reducing RTN.

15. The portable communication device of claim 10, wherein pulses of the train of pulses have equal pulse widths and are provided at equal time intervals.

16. The portable communication device of claim 10, wherein a second node of the current source is coupled to bias voltage, and wherein respective first nodes of the plurality of diodes are coupled to the ground potential through a variable resistor.

17. The portable communication device of claim 10, further comprising an amplifier circuit configured to provide the reference voltage based on the output voltage of the bandgap circuit.

18. A cyclic switching circuit comprising:

a current source, a first node of the current source being coupled to a first node of a first resistor and to a first node of a resistor voltage divider; and a plurality of diodes coupled in parallel at respective first nodes of the plurality of diodes to a ground potential;

a plurality of switches coupled to respective second nodes of the plurality of diodes; and a differential amplifier circuit, wherein:

the plurality of switches are used to implement cyclic switching of the plurality of diodes in response to a train of pulses to reduce RTN, input nodes of the differential amplifier circuit are coupled to a mid-node of the resistor voltage divider and a second node of the first resistor, and the differential amplifier circuit is configured to generate a reduced-RTN reference voltage.

19. The cyclic switching circuit of claim 18, further comprising a clock management circuit configured to generate the train of and to implement the cyclic switching of the plurality of diodes by operating each switch of the plurality of switches to couple a second node of a respective one of the plurality of diodes to the second node of the first resistor in response to a respective signal applied to that switch, while other switches of the plurality of switches are operated to couple second nodes of other diodes of the plurality of diodes to a second node of the resistor voltage divider.

20. The cyclic switching circuit of claim 19, wherein the respective signal comprises a pulse of the train of pulses, wherein the clock management circuit is configured to sequentially apply the pulses of the train of pulses to switches of the plurality of switches, wherein pulses of the train of pulses have equal pulse widths and are provided at equal time intervals, wherein a second node of the current source is coupled to bias voltage, and wherein the respective first nodes of the plurality of diodes are coupled to the ground potential through a variable resistor.

* * * * *